United States Patent [19]

Greive

[11] 4,231,531

[45] Nov. 4, 1980

[54] DRIVE SYSTEM FOR A YARN EYE OR YARN WINDER

[75] Inventor: Aloys Greive, Münster, Fed. Rep. of Germany

[73] Assignee: Hamel GmbH, Zwirnmaschinen, Münster, Fed. Rep. of Germany

[21] Appl. No.: 25,182

[22] Filed: Mar. 29, 1979

[30] Foreign Application Priority Data

Apr. 5, 1978 [DE] Fed. Rep. of Germany ..... 2814759

[51] Int. Cl.[3] ..... B65H 54/38

[52] U.S. Cl. ..... 242/18.1; 242/43 R

[58] Field of Search ..... 242/18.1, 43 R

[56] References Cited

U.S. PATENT DOCUMENTS

| | | | |
|---|---|---|---|
| 2,181,267 | 11/1939 | Elvin et al. | 242/43 R |
| 2,230,653 | 2/1941 | Nelson | 242/43 R |

FOREIGN PATENT DOCUMENTS

| | | | |
|---|---|---|---|
| 1535081 | 5/1970 | Fed. Rep. of Germany | 242/18.1 |
| 2353234 | 5/1974 | Fed. Rep. of Germany | 242/18.1 |
| 646535 | 7/1928 | France | 242/18.1 |
| 536009 | 4/1941 | United Kingdom | 242/18.1 |
| 537430 | 6/1941 | United Kingdom | 242/18.1 |
| 676442 | 7/1952 | United Kingdom | 242/18.1 |
| 705782 | 3/1954 | United Kingdom | 242/18.1 |

*Primary Examiner*—Stanley N. Gilreath
*Attorney, Agent, or Firm*—Karl F. Ross

[57] ABSTRACT

A machine wherein a yarn is fed at a constant delivery speed through a yarn eye to a yarn package rotated at a constant peripheral speed has a drive system connected to the yarn eye to reciprocate it at an irregular rate to wind the yarn irregularly on the package. This yarn eye is connected through a cam to a sun gear in mesh with a planet gear carried on a planet carrier and rotationally coupled to a starwheel. A control wheel and the planet carrier are continuously rotated at different speeds. This control wheel has formations which prevent the starwheel from rotating during part of each orbit of the starwheel about the machine axis and which rotate the starwheel at a fixed speed during another part of each orbit so that the displacement speeds of the cam and, hence, of the yarn eye alternate between two separate rates for most effective irregular winding.

10 Claims, 8 Drawing Figures

DRIVE SYSTEM FOR A YARN EYE OR YARN WINDER

FIELD OF THE INVENTION

The present invention relates to a drive system for reciprocating the yarn eye of a yarn-winding machine. More particularly this invention concerns such a drive system usable with a yarn-twisting apparatus.

BACKGROUND OF THE INVENTION

An apparatus for cable-twisting two yarns is described in commonly owned and copending applications 886,802 and 899,735 respectively filed 15 Mar. and 25 Apr. 1978 now U.S. Pat. Nos. 4,180,967 and 4,163,357, respectively. In these devices a pair of yarns are wound together and the thus doubled yarn is wound onto a yarn package. The package is rotated at a generally constant peripheral speed by means of a drive roller which peripherally engages it. The yarn is fed through a yarn eye to this yarn package and the yarn eye itself is reciprocated along the package so as to distribute the yarn evenly over the entire package.

It is essential that the yarn not be wound tightly and evenly in this package, but that instead it be wound in an irregular manner, although normally with a constant tension. Such a package is frequently later treated by immersion in a dye or other treatment liquid, so that it is essential that the package be somewhat irregularly wound in order to ensure good penetration of the treatment fluid. Furthermore it must be possible to wind the yarn off the package very easily, for subsequent treatment of the yarn, or weaving or knitting with the yarn.

In the simplest system for achieving this uneven winding, the yarn eye is reciprocated at a regular or sinusoidally regular speed and the drive roller for the takeup spool is similarly driven at a constant speed. This drive roller is, however, periodically lifted slightly from engagement with the package it is driving, so that the peripheral speed of this package varies somewhat. The result is the desired uneven winding in most cases. The same effect can be achieved, of course, by varying the drive speed for the drive roller of the yarn package. Such a system is not, however, useful in conjunction with a twisting machine which must operate at a constant takeup speed in order to ensure regular twisting of the yarns.

German published application No. 2,353,234 describes a system different from that described above wherein the peripheral speed of the yarn package is maintained constant so that it can be used with a yarn-twisting apparatus, and wherein the reciprocation rate of the yarn eye is made irregular in order to produce the desired irregular winding. This arrangement drives the yarn eye by means of a cam follower engaging a cam that is rotated by means of a sun gear in turn engaged by a planet gear carried on a planet carrier that is rotated at a constant speed by means of a constant-speed input gear. The planet gear can rotate in the planet carrier and is connected via an entrainment element to a continuously rotated control wheel in such a manner that the rotation rate of the planet gear is varied to change the rotation rate of the cam and, hence, the reciprocation rate of the yarn eye. To this end the drive shaft for the system has two relatively rotatable gears next to each other and each meshing with a respective driven gear in such a manner that the driven gears are rotated at different speeds. The gear farthest from the cam is provided with an axial cam lobe which, seen radially from the side, rises on one half of its periphery and falls on the other half of its periphery. The gear closer to the cam is axially slidable in a groove of a spring-loaded link which carries on its end turned toward the cam lobe a roller which is provided on its other end with a sawtooth formation. A pawl on the cam has an inclined groove that mates with the sawtooth formation on the link. Since the roller is pressed by the spring-loaded link against the cam lobe and since the gears rotate at different speeds the link moves back and forth in the inclined groove of the pawl. This motion of the link accelerates or slows the rotation of the cam corresponding to the slope of the cam lobe.

In practice it has been found that this continuously and smoothly increasing and decreasing of the reciprocatin speed of the yarn eye does not always avoid the formation of patterns in the yarn being wound onto the yarn package. In particular when large-diameter yarn packages are being wound the periodically increasing and decreasing reciprocation rate for the yarn eye can cause the formation of relatively dense patterns that make subsequent fluid treatment and unwinding of the yarn package quite difficult.

In published German patent application No. 1,535,081 another arrangement is provided wherein a plurality of planet gears journaled in an annular planet-gear carrier mesh on one side with the sun gear of the cam and on the other side in a ring gear having inner and outer arrays of teeth. The planet-gear carrier is journaled on the sun gear and the ring gear on the planet-gear carrier. The ring gear of the planetary gear transmission is driven by means of a drive gear directly on the drive shaft. The control wheel is also driven by a gear mounted directly on the drive shaft and the rotation speeds are such that the control wheel rotates at a rate which is slightly different from that of the ring gear. In this arrangement the entrainment element is formed by a plate between the planetary-gear arrangement and the adjacent gear, this plate being fixed on the ring gear and being slidable therein. The plate carries an entrainment bolt which engages in a radial groove of the planet-gear carrier. The gear adjacent the planetary-gear transmission is provided with an eccentric hub to which is affixed a grooved control ring. A cam follower is engaged in this control ring and is connected to the entrainment plate. The control ring can be fixed at different angles by means of latching bolts relative to the eccentric hub so that the eccentricity of the groove, relative to the axis of the ring gear, can be set larger or smaller. As a result of the differential in speed between the ring gear and the adjacent gear and as a result of the eccentricity of the grooves the entrainment plate is shifted slowly inside the guide. As a result of this radial displacement relative twisting is transmitted by the bolt between the planet-gear carrier and the ring gear. This twisting is transmitted to the eccentric and, in accordance with the position of the entrainment of the plate, the reciprocation rate of the yarn eye increases and decreases continuously.

Once again this continuous increasing and decreasing of the reciprocation rate for the yarn eye ensures that adjacent turns of the yarn on the package will not be exactly parallel. These turns will, however, be close to parallel and in a large-diameter spool will, once again, produce some patterned winding. Furthermore the above-described equipment is relatively complex and failure-prone.

OBJECTS OF THE INVENTION

It is therefore an object of the present invention to provide an improved drive system for a yarn eye in a yarn-winding machine.

Another object is to provide such a system that is relatively simple and which completely prevents the formation of patterns.

Another object is to provide such an arrangement which when used with large-diameter yarn packages will not produce patterned winding.

SUMMARY OF THE INVENTION

These objects are achieved according to the instant invention in a drive system wherein the reciprocation rate of the yarn eye is not varied smoothly and continuously, but is alternated back and forth between at least two different reciprocation rates. Thus part of the time the yarn eye will be moving at one rate, and then it will shift almost instantaneously to displacement at a second rate, and then back. This type of operation ensures complete avoidance of patterned winding even when winding very large yarn packages.

Accordingly the drive system of the instant invention, which is of the general type described above, has a control wheel rotatable about the axis of the planet carrier and having a pair of angularly offset control regions. The entrainment element is connected between these regions of the control wheel and the planet gear. Means is provided including respective formations on the control regions for rotating the cam at one predetermined speed when the element engages one of the regions and for rotating the cam at another different speed when the element engages the other region. This means being effective through the planet gear that meshes with the sun gear rotationally joined to the cam.

According to this invention the control wheel is coaxial with and immediately adjacent to the planet carrier. Both the sun gear and the planet carrier are externally toothed and mesh with respective drive gears both fixed on a common drive shaft that is continuously rotated at a constant speed. The relative numbers of teeth are such that the control wheel rotates slightly faster or slower than the planet carrier. In order to minimize the space taken up by the device the control wheel is formed with an axially extending and axially centered ridge provided internally with the above-described formation. Such a provision allows the control wheel to be journaled on the hub of the planet carrier.

According to another feature of this invention the planet gear is rotatable about a planet axis offset from but parallel to the main axis common to the cam, sun gear, planet carrier, and control wheel. This planet gear is rotationally coupled to the entrainment element that is radially alignable with the regions of the control wheel. The control wheel is constructed such that the formation of the one region prevents rotation of the entrainment element when it is radially aligned therewith and also rotates this element and the planet gear at a predetermined rate when the element is radially aligned with the formation of the other region. Thus while traveling past the one region the planetary gear will be fixed so that the cam and planet carrier will be rotationally joined, whereas while traveling past the other region the planet gear will rotate so that the cam and planet carrier will rotate relative to each other. The changeover between these two states is dependent on the relative rates of rotation of the control wheel and planet carrier, as well as on how many of the one regions and the other regions are provided on the control wheel. It is of course possible to provide two, three, or more such one regions on the control wheel. It is also within the scope of this invention to provide the arrangement with two different types of the other regions, so that when the entrainment element is engaged with one it rotates the planet gear at a first predetermined rate whereas when engaged with the other it rotates it at a second predetermined rate. If necessary the device can be set up to step the rotation speed of the planet gear through three or more different rates, with the average rate of travel in each such zone being constant.

According to further features of this invention the entrainment element is formed as a star wheel having teeth or points engageable between roller-type tooth formations on the control wheel in the other region thereof. In addition this star wheel has stops or rollers engageable with the edge of a ridge formed on the control wheel, which edge is centered on the main axis of the device and constitutes the one region.

To prevent reverse rotation of the planet gear or reverse driving thereof when the speed of the device moves from a relatively fast speed to a relatively slow speed, a unidirectional coupling is provided between the planet carrier on one side and on the other side the shaft on which both the entrainment element and the planet gear are mounted.

According to this invention the control wheel is generally cup-shaped, having an axially extending and axially centered ridge having an inwardly directed ridge or rim forming the one region. Thus the entrainment element can be contained within a relatively small space between the juxtaposed control wheel and the planet carrier. It is also possible within the scope of this invention to provide a plurality of cam followers engaging this main cam and each carrying or connected to a respective yarn eye, so that a single such drive system can be used to operate the yarn eyes for a plurality of yarn-winding devices.

SPECIFIC DESCRIPTION

Figure 1:
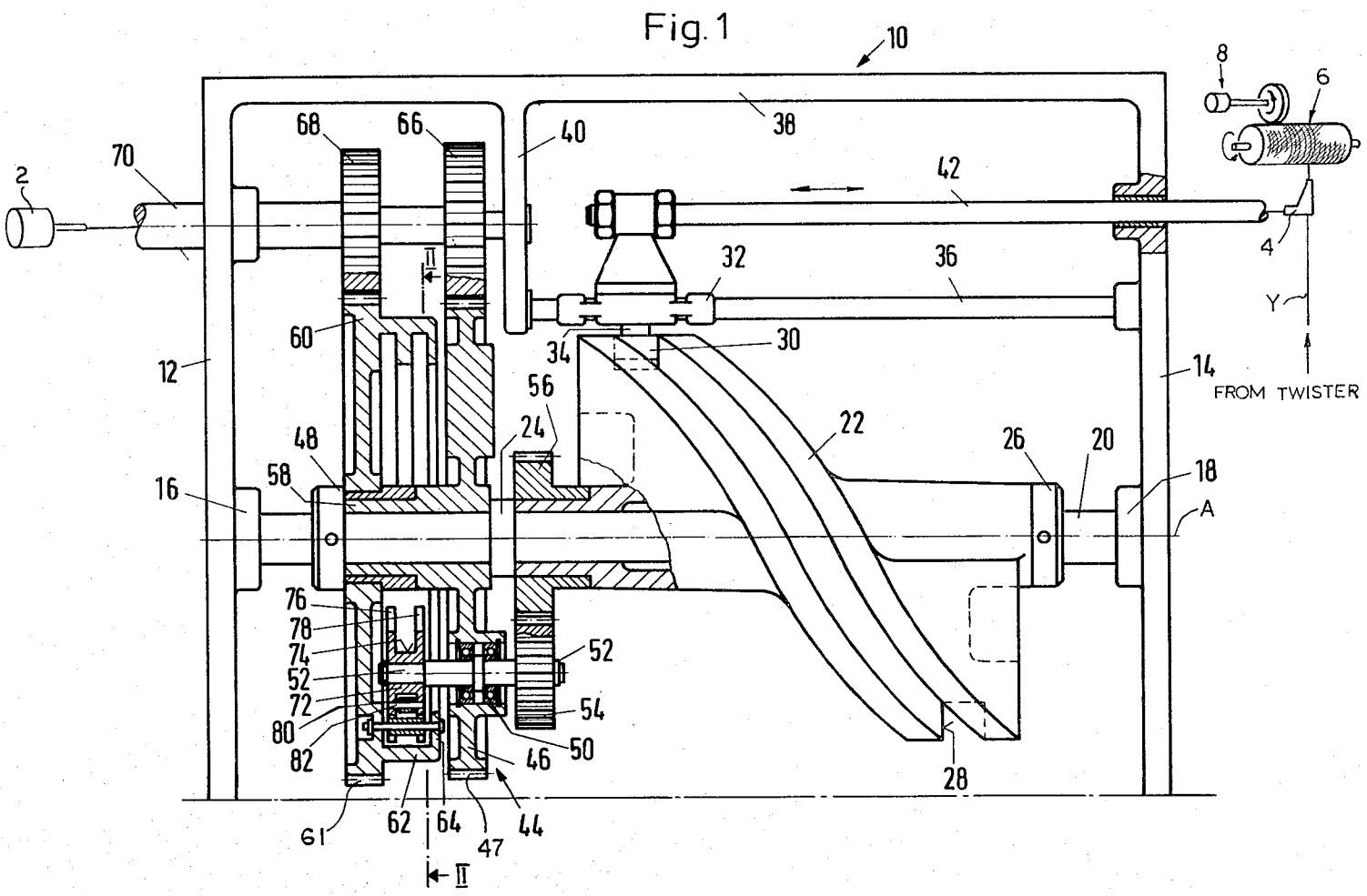
FIG. 1 is a top and partly schematic view of the apparatus according to this invention.
Figure 3:
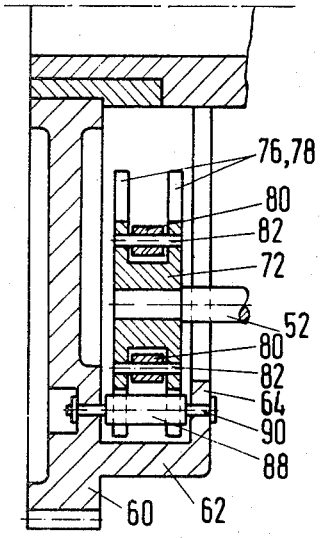
FIG. 3 is a section taken along line III—III of FIG. 2.

As shown in FIGS. 1-5 a drive system according to this invention is used for twisting a yarn Y and is connected between a drive motor 2 whose output turns at a constant speed and a yarn guide 4. The yarn Y coming from a twister is wound on a package 6 that is rotated by means of a package drive 8 at a constant peripheral speed. The arrangement according to this invention can be used in a system such above-cited copending and commonly owned patent applications Nos. 886,802 and 899,735 respectively filed Mar. 15 and Apr. 25, 1978. The yarn eye 4 indicated here in FIG. 1 is identified in FIG. 1 of these two applications with reference 51. In order to form a yarn package suitable for later dyeing or other treatment it is necessary that the yarn Y be wound in an irregular manner on the package 6, but with substantially even tension.

Accordingly the drive system according to this invention as shown in FIGS. 1–5 has a housing 10 with a pair of end walls 12 and 14 in which bearings 16 and 18 mount a shaft 20 for rotation about a horizontal main axis A. This shaft 20 rotatably carries a slave cam 22, held axially in place between a pair of collars 24 and 26 on the shaft 20. The cam 22 is formed with a helical endless groove 28 in which is engaged a cam-follower roller 30 carried on a slider 32 by means of an axle 34. The slider 32 is carried on a pair of vertically spaced and parallel guide rods 36 extending between the one end wall 14 of the housing and an intermediate web 40 extending inwardly from a side wall 38 of the housing 10. A rod 42 extending parallel to the axis A has one end fixed to the slider 32 and another end carrying the yarn guide 4. The groove 28 is sinusoidal so that the axial movement of the yarn eye 4 will follow the angular movement of the cam 22.

A planetary-gear transmission 44 has a planet carrier 46 rotatable on the shaft 20 and held between the collar 24 and another collar 48 against axial displacement thereon. This planet carrier has a bearing 50 defining an axis A′ parallel to the axis A and carrying a shaft 52 to which is fixed a planet gear 54 meshing with a sun gear 56 centered on the axis A and connected to the cam 22 for joint angular displacement therewith. Thus if the gear 54 could not rotate, rotation of the planet carrier 46 would rotate the cam 22 synchronously at the same angular speed.

This planet carrier 46 has an axial hub extension 58 on which is journaled a control wheel or disk 60 that can rotate relative to the planet carrier 46 about the axis A, but that also engages the ring 48 so as to be axially nondisplaceable. This control wheel 60 is formed with a circularly annular rim or ridge 62 extending axially toward the planet carrier 46 and formed with a radially inwardly directed rim 64. The ridge 62 and rim 64 are centered on the axis A.

A pair of main drive pinions 66 and 68 both fixed on the main drive shaft 70 coupled to the shaft of the motor 2 respectively mesh with teeth 47 and 61 of the planet carrier 46 and the control wheel 60. The diameters and/or numbers of teeth of the gears 66 and 68 and of the planet carrier 46 and control wheel 60 are such that with the two gears 66 and 68 rotating at the same angular speed the planet carrier 46 will rotate at an angular speed different from that of the control wheel 60.

Figure 2:
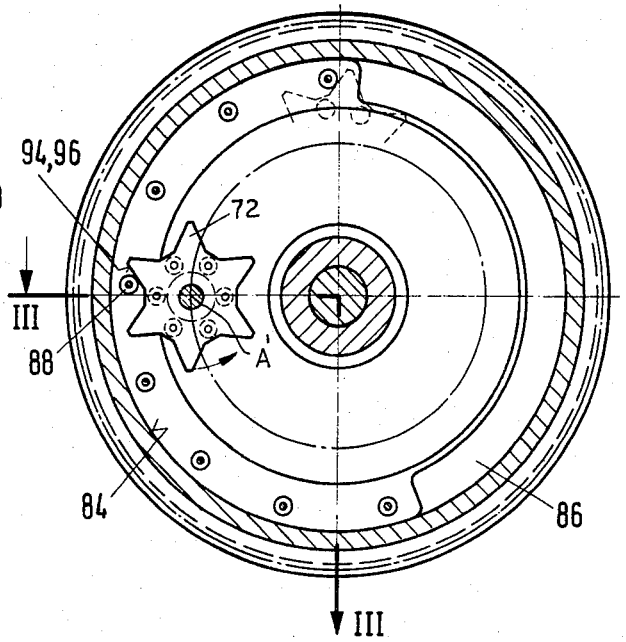
FIG. 2 is a section taken along line II—II of FIG. 1.
Figure 5:
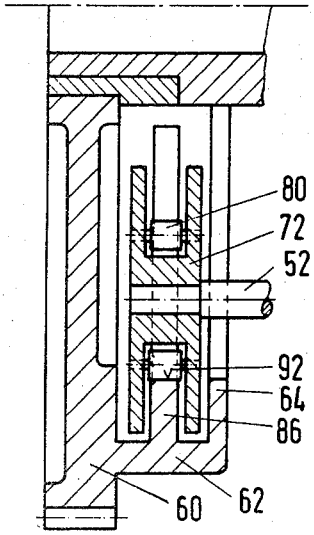
FIGS. 4 and 5 are views corresponding to FIGS. 2 and 3 showing the arrangement of FIG. 1 in another position.
Figure 4:
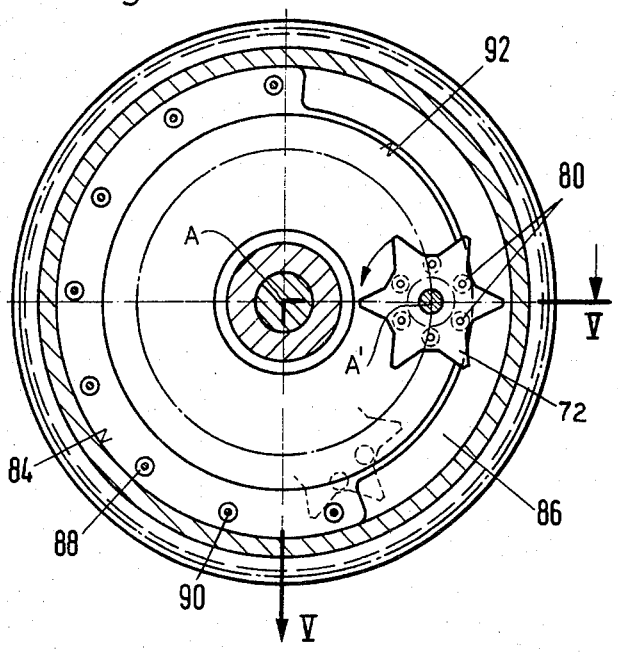

An entrainment element constituted as a wheel 72 is fixed to the end of the shaft 52 remote from the gear 54 and is formed as a pair of starwheels having two arrays of teeth 76 and 78 separated by a radially outwardly open groove 74. In addition as best shown in FIGS. 2 and 4 the starwheel 72 is provided at the base of the roots between the teeth 76 and 78 with entrainment bodies in the form of rollers 80 carried on an axially extending shaft 82.

The rim 64 and face of the wheel 60 define a radially inwardly open groove 84 in which the teeth 76 and 78 may orbit. This groove 84 is formed over approximately 150° with a radially inwardly extending ridge 86 having an inner edge 92. The rest of the groove 84, over approximately 210°, is provided with eight angularly equispaced tooth formations constituted as rollers 88 carried on axial pins 90, in effect forming a segment of an internally toothed ring gear.

The radial spacing between the axis A′ of the shaft 52 and the axis A plus the radial spacing between the axis A′ and the radial outermost part of any of the angularly equispaced pins 82 is slightly more than the radial distance between the inner edge 92 and the axis A, so that when the wheel 72 is angularly aligned with the ridge or formation 86 it will be unable to rotate, in the fashion of a Geneva wheel.

In addition the radial spacing between any of the rollers 88 and the axis A is less than the sum of the radial spacing between the axes A and A′ plus the radial distance between the axis A′ and the tip of any of the teeth 76 or 78. Thus the rollers 88 will engage the flanks 94 and 96 of the teeth 76 and 78 and will cause the wheel 72 to rotate or roll off when the wheel 72 orbits past the region of these rollers 88. Since the wheel 72 has six such teeth 76 and 78 and there are eight such rollers 88, this will mean that in the 210° of angular travel when not engaged with the formation 86 the wheel 72 will rotate step-wise through one and one-quarter revolutions about the axis A′.

Thus it is apparent that, assuming the control wheel 60 stands still, the planet carrier 46 will rotate synchronously and jointly with the cam 22 while the wheel 72 is angularly aligned with the ridge 86, but limited relative rotation will be possible as the wheel 72 rolls off on the rollers 88 as shown in FIG. 2. It is to be noted, however, that both the control wheel 60 and the planet carrier 46 in this arrangement rotate relative to each other at respective angular speeds, so that the alternating change in speed of the cam 22 driven by the planet gear 54 can move between the two rates of rotation much more frequently than once for each revolution of the planet carrier 46 or, alternatively, much more slowly then once for each revolution of the planet carrier 46. The angular rotation rates discussed here are the average rates of travel of the cam 22 during angular engagement of the wheel 72 either with the formation 86 or with the formation 88.

Thus with the system according to the instant invention the angular rotation speed of the cam 22 will not merely vary cyclically, but will alternate suddenly and sharply back and forth between two different speeds. Thus even when winding a relatively large yarn package good criss-crossing of the yarns in adjacent layers is ensured with random overlying of the yarn.

Figure 6:
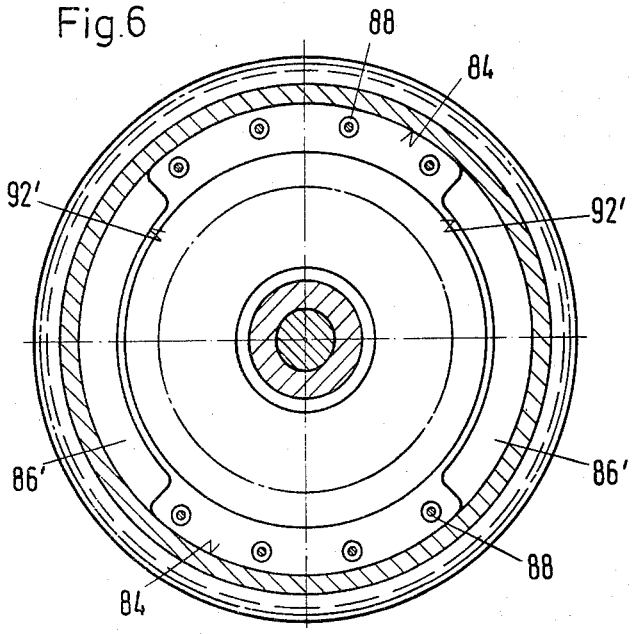
FIGS. 6 and 7 are views corresponding to FIG. 2 showing other arrangements in accordance with this invention.

It is also possible as shown in FIG. 6 to provide the wheel with two such ridges 86′ having respective inner edges 92′ so that two groups of rollers 88 are provided.

Figure 7:
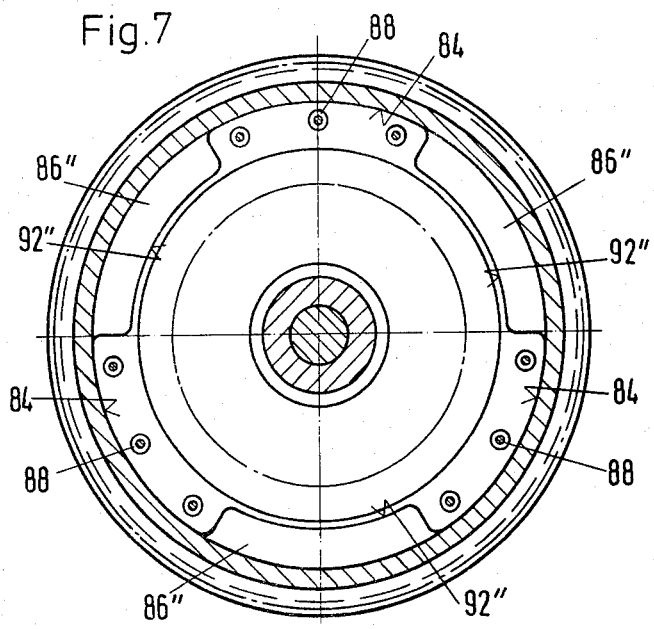

FIG. 7 shows an arrangement with three such ridges 86″ where inner surfaces 92″ are provided. These arrangements function substantially identically to that of FIG. 1, except that the switching back and forth between the two rotation speeds with the cam 22 occurs more frequently.

Figure 8:
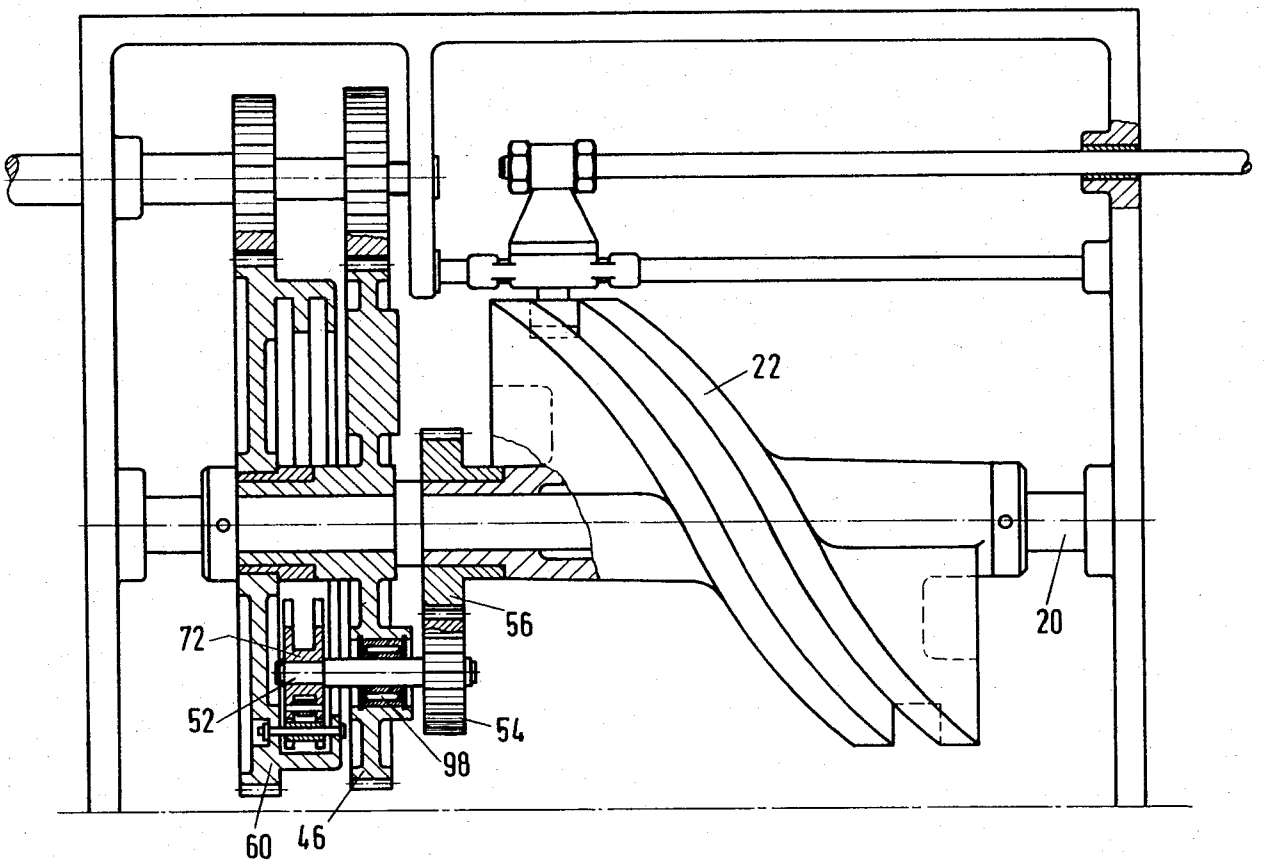
FIG. 8 is a view similar to FIG. 1 showing another drive system according to the present invention.

Finally FIG. 8 shows an arrangement wherein the roller bearing 50 is replaced by a one-way coupling 98 that prevents reverse rotation of the shaft 52 in the planet carrier 46. It has been found that such an arrangement is occasionally helpful to prevent backlash in the parts during the shiftover in direction changes.

I claim:

1. In an arrangement wherein a yarn is fed at a generally uniform delivery speed through a yarn eye to a yarn package rotated at a generally uniform peripheral speed, and wherein the yarn eye is reciprocated with a nonuniform speed adjacent the package to wind the yarn irregularly on the package, a drive system comprising:

a planet carrier rotatable about a main axis;

a planet gear rotatable on said carrier and orbitable therewith about said axis;

an output gear in mesh with said planet gear;

a cam rotationally coupled to said output gear and jointly rotatable therewith;

means including a cam follower connected between said cam and said yarn eye for reciprocating said eye at a speed generally proportional to the rotation speed of said cam;

a control wheel rotatable about said axis and having a pair of angularly offset control regions;

means including an input adapted to be rotated at a substantially constant speed and a pair of outputs respectively connected to said carrier and control wheel for rotating same at substantially constant but different angular speeds;

an entrainment element engageable with said regions of said control wheel and rotationally coupled to said planet gear; and control means including respective formations on said control regions for rotating said cam at one predetermined speed when said element engages one of said regions and for rotating said cam at another different speed when said element engages said other region.

2. The drive system defined in claim 1 wherein said planet gear is rotatable about a planet axis and is rotationally coupled to said entrainment element, said control means having means including the formation of said one region for preventing rotation of said element and said planet gear when said element is radially aligned with said formation of said one region and means including the formation of said other region for rotating said element and said planet gear at a predetermined rate when said element is radially aligned with said formation of said other region.

3. The drive system defined in claim 2 wherein said formation of said one region is a continuous ridge having an edge centered one said main axis, said entrainment element being engageable with more than line contact on said edge.

4. The drive system defined in claim 3 wherein said element has a plurality of angularly spaced rollers equispaced from said planed axis, the distance from said planet axis to the most remote part of each roller plus the distance between said axes being greater than the radial distance between said main axis and said edge, whereby two such rollers simultaneously ride on said edge when aligned therewith.

5. The drive system defined in claim 2 wherein said formation at said other region is a plurality of angularly spaced tooth formations, said entrainment element being a starwheel having teeth engageable between said tooth formations for meshing of said starwheel therewith and rolling-off of said starwheel therein.

6. The drive system defined in claim 5 wherein each of said tooth formations is formed as a roller.

7. The drive system defined in claim 2 wherein said control wheel has a plurality of such one regions and a plurality of such other regions, whereby the speed of said cam changes more than twice for each revolution of said control wheel.

8. The drive system defined in claim 2, further comprising unidirectional coupling means for preventing reverse rotation of said planet gear relative to said planet carrier.

9. The drive system defined in claim 2, wherein said sun gear is coaxial with and fixed on said cam.

10. The drive system defined in claim 2 wherein said cam is a slave cam having a generally helical groove, said follower being engaged in said groove.

* * * * *